US009383764B1

(12) United States Patent
Tanimoto

(10) Patent No.: US 9,383,764 B1
(45) Date of Patent: Jul. 5, 2016

(54) APPARATUS AND METHOD FOR A HIGH PRECISION VOLTAGE REFERENCE

(71) Applicant: Dialog Semiconductor (UK) Limited, Reading (GB)

(72) Inventor: Susumu Tanimoto, Tokyo (JP)

(73) Assignee: Dialog Semiconductor (UK) Limited, Reading (GB)

( * ) Notice: Subject to any disclaimer, the term of this patent is extended or adjusted under 35 U.S.C. 154(b) by 10 days.

(21) Appl. No.: 14/608,494

(22) Filed: Jan. 29, 2015

(51) Int. Cl.
*G05F 3/26* (2006.01)

(52) U.S. Cl.
CPC ..... *G05F 3/262* (2013.01)

(58) Field of Classification Search
CPC ..... G05F 1/613; G05F 3/08; G05F 3/16; G05F 3/30
See application file for complete search history.

(56) References Cited

U.S. PATENT DOCUMENTS 5,363,059 A * 11/1994 Thiel ..... H03F 3/72 330/253
5,376,839 A 12/1994 Horiguchi et al.
5,434,533 A * 7/1995 Furutani ..... G05F 1/463 323/313
5,451,898 A * 9/1995 Johnson ..... H03K 17/145 327/53
5,469,111 A * 11/1995 Chiu ..... G05F 3/30 327/538
5,485,111 A * 1/1996 Tanimoto ..... H03K 17/223 327/143
5,801,564 A * 9/1998 Gasparik ..... H03F 3/3028 327/112
6,411,159 B1 * 6/2002 Callahan, Jr. ..... G05F 3/242 327/538
6,452,458 B1 * 9/2002 Tanimoto ..... H03K 3/0231 327/280
6,573,779 B2 * 6/2003 Sidiropoulos ..... H03F 3/45183 327/345
6,812,683 B1 * 11/2004 Lorenz ..... G05F 3/245 323/312

(Continued)

OTHER PUBLICATIONS

German Office Action 102015210217.3, Nov. 19, 2015, Dialog Semiconductor Inc.

(Continued)

*Primary Examiner* — Timothy J Dole
*Assistant Examiner* — Yusef Ahmed
(74) *Attorney, Agent, or Firm* — Saile Ackerman LLC; Stephen B. Ackerman

(57) ABSTRACT

An apparatus and method for a voltage reference circuit with improved precision. The voltage reference circuit utilizes threshold voltage difference between a pair of MOSFETs. A voltage reference circuit between a power supply node and a ground node and configured for generating a reference voltage, includes a first current mirror with a first NMOS transistor and a second NMOS transistor wherein said first NMOS transistor threshold voltage is not equal to said second NMOS transistor threshold voltage, a second current mirror with a first PMOS transistor, a second and third PMOS transistor configured to be coupled to said power supply node, a current source configured to be provide current to said second current mirror, an amplifier configured with a first and second input configured to be connected to the drains of said first NMOS transistor and said second NMOS transistor and, a feedback loop configured to be the output of said amplifier.

26 Claims, 5 Drawing Sheets

(56) References Cited

U.S. PATENT DOCUMENTS 7,236,048 B1 * 6/2007 Holloway ..... G05F 3/30 327/512
7,564,225 B2 7/2009 Moraveji et al.
7,727,833 B2 6/2010 Dix
7,880,533 B2 * 2/2011 Marinca ..... G05F 3/30 327/539
8,264,214 B1 9/2012 Ratnakumar et al.
8,581,569 B2 * 11/2013 Fonderie ..... G05F 3/262 323/316
8,729,951 B1 * 5/2014 Choy ..... H03L 5/02 327/309
2002/0042176 A1 * 4/2002 Ikehashi ..... G05F 3/242 438/200
2004/0150381 A1 * 8/2004 Butler ..... G05F 3/30 323/313
2005/0088163 A1 * 4/2005 Tachibana ..... G05F 3/30 323/313
2005/0194957 A1 * 9/2005 Brokaw ..... G05F 3/30 323/316
2009/0108917 A1 * 4/2009 Chellappa ..... G05F 3/30 327/539
2009/0160537 A1 * 6/2009 Marinca ..... G05F 3/30 327/539
2009/0189454 A1 * 7/2009 Kitamura ..... G05F 3/30 307/80
2010/0052643 A1 * 3/2010 Cho ..... G05F 3/30 323/313
2010/0201406 A1 * 8/2010 Illegems ..... G05F 3/242 327/109
2011/0006749 A1 * 1/2011 Stellberger ..... G05F 3/30 323/313
2011/0012581 A1 * 1/2011 Wang ..... G05F 3/30 323/313
2011/0025285 A1 * 2/2011 Hirose ..... G05F 3/242 323/284
2011/0068766 A1 * 3/2011 Nag ..... G05F 3/30 323/313
2011/0187344 A1 * 8/2011 Iacob ..... G05F 3/16 323/315
2012/0229117 A1 * 9/2012 Nikolov ..... G05F 3/242 323/313
2013/0002351 A1 * 1/2013 Carvalho ..... G05F 3/242 330/253
2013/0106391 A1 * 5/2013 Tran ..... G05F 3/30 323/313
2013/0328542 A1 * 12/2013 Wang ..... G05F 3/245 323/313
2014/0117956 A1 * 5/2014 Price ..... G05F 1/613 323/274
2015/0116027 A1 * 4/2015 Venkiteswaran ..... G05F 1/463 327/513
2015/0160680 A1 * 6/2015 Marinca ..... G05F 3/30 323/313
2015/0214903 A1 * 7/2015 Zhang ..... H03F 1/301 330/291
2015/0301551 A1 * 10/2015 Childs ..... G05F 3/267 323/313

OTHER PUBLICATIONS

"MOS Voltage Reference Based on Polysilicon Gate Work Function Difference," by Henri J. Oguey, et al., IEEE Journal of Solid-State Circuits, vol. SC-15, No. 3, Jun. 1980, pp. 264-269.

"CMOS Voltage Reference Based on Gate Work Function Differences in Poly-Si Controlled by Conductivity Type and Impurity Concentration," by Hirobumi Watanabe, et al., IEEE Journal of Solid-State Circuits, vol. 38, No. 6, Jun. 2003, pp. 987-994.

* cited by examiner

APPARATUS AND METHOD FOR A HIGH PRECISION VOLTAGE REFERENCE

BACKGROUND

1. Field

The disclosure relates generally to a voltage reference circuit and, more particularly, to a voltage reference circuit device for a high precision thereof.

2. Description of the Related Art

Voltage reference circuits are a type of circuit used in conjunction with semiconductor devices, integrated circuits (IC), and other applications. Voltage reference circuits can be classified into different categories. These can include (a) bandgap reference circuits, (b) circuits based on MOSFET transistor threshold voltage differences, (c) MOSFET threshold voltage and mobility compensated circuits, (d) current mode circuits, and (e) MOSFET beta multiplier networks.

FIG. 1 is an example of a prior art circuit 100 with ground (e.g. VSS) 101, and negative power supply VCC 102. The n-channel MOSFET devices T1 110 and T2 120 are used as reference MOS transistors. The transistor T3 130 is a MOSFET device with an n-type doped MOSFET gate structure. N-channel MOSFET T2 120 also has a long MOSFET channel. The MOSFET T3 130 current is "mirrored" by the current mirror formed by the two MOSFET devices T4 140 and T5 150. The current mirror formed by p-channel MOSFET devices T4 140 and T5 150 adjusts itself to the value corresponding to the cross-point of the characteristics of MOSFET device T1 110 and MOSFET device T3 130. The MOSFET devices T7 170, T8 180 and T9 190 establishes a second current mirror network which forces equal currents through the MOSFET devices T1 110 and T2 120. To initiate the start-up of the circuit, n-channel MOSFET device T6 160 conducts current when the power supply is switched on, which is provided by a positive gate voltage from the capacitor C 103. The leaky poly-silicon diode D 104 discharges through the capacitor C 103 and cuts off the n-channel MOSFET device T6 160. This circuit works properly when the power supply voltage exceeds $V_{CC}$>1.5V. The prior art needs six MOSFETs, T1 110, T2 120, T5 150, T7 170, T8 180, and T9 190. In order to get a high precision output voltage, the electrical properties of these devices must have precise matching. To achieve accurate matching characteristics, the transistors must be large to minimize semiconductor manufacturing variation (e.g. photolithography and etch variations, across chip linewidth variation (ACLV), and material changes). Additionally, transistors T1 110 and T2 120 have threshold voltage variations and mismatch which leads to a voltage reference difference due to the voltage difference of each drain voltage. The disadvantages of this implementation to achieve a voltage reference circuit with high precision is the number of transistors, the physical size of the transistors, chip area, and cost.

U.S. Pat. No. 7,564,225 to Moraveji et al describes a voltage reference circuit that utilizes a work function difference between p+ gate and n+ gate to generate a pre-determined reference voltage. Additionally, the pre-determined reference voltage can be pre-adjusted using gate materials with different work functions.

U.S. Pat. No. 7,727,833 to Dix describes a voltage reference from an operational amplifier having identical PMOS transistors with each having a different gate dopant. The difference between the two threshold voltages is then used to create the voltage reference equal to the difference. The two PMOS transistors are configured as a differential pair.

U.S. Pat. No. 8,264,214 to Ratnakumar et al shows a low-voltage reference circuit which has a pair of semiconductor devices. Each semiconductor device may have an n-type semiconductor region.

In the previously published article, "MOS Voltage Reference Base on Polysilicon Gate Work Function Difference," IEEE Journal of Solid-State Circuit, Volume SC-15, No. 3, June 1980, a voltage reference circuit is discussed that operates on MOSFET gate work-function differences.

In the previously published article "CMOS Voltage Reference Based on Gate Work Function Differences in Poly-Si Controlled by Conductivity Type and Impurity Concentration," IEEE Journal of Solid-State Circuit, Volume 38, No. 6, June 2003, the voltage reference circuit operates on differences in the conductivity and impurity concentration.

In these prior art embodiments, the solution to improve the operability of a low voltage reference circuit utilized various alternative solutions.

It is desirable to provide a solution to address the disadvantages of operation of a voltage reference circuit.

SUMMARY

A principal object of the present disclosure is to provide a voltage reference circuit which allows for operation of a circuit that is less costly.

A principal object of the present disclosure is to provide a voltage reference circuit which allows operation of a circuit that is reduced in size.

A principal object of the present disclosure is to provide a voltage reference circuit which allows for improvement in accuracy.

A principal object of the present disclosure is to provide a voltage reference circuit which allows for less dependency on power supply voltage.

Another further object of the present disclosure is to provide a voltage reference circuit which allows for improvement in accuracy due to maintaining drain voltage matching.

Another further object of the present disclosure is to provide a voltage reference circuit which allows for improvement in accuracy due to maintaining drain voltage matching even though source voltage nodes and source voltage are not matched.

Another further object of the present disclosure is to provide a voltage reference circuit with fewer transistors.

Another further object of the present disclosure is to provide a voltage reference circuit with fewer transistors allowing for improved matching.

Another further object of the present disclosure is to provide a voltage reference circuit with fewer transistors that is smaller and still maintain accuracy.

In summary, a voltage reference circuit between a power supply node and a ground node and configured for generating a reference voltage, comprising of a voltage network comprises a first current mirror with a first NMOS transistor and a second NMOS transistor wherein said first NMOS transistor threshold voltage is not equal to said second NMOS transistor threshold voltage, a second current mirror with a first PMOS transistor, a second PMOS transistor and third PMOS transistor configured to be coupled to said power supply node, wherein the first PMOS transistor is coupled to the gate of the second PMOS transistor, and third PMOS transistor wherein said second PMOS transistor and third PMOS transistor drains are coupled to said first NMOS transistor drain and said second NMOS transistor drain, a current source configured to be provide current to said second current mirror, an amplifier configured with a first and second input configured to be connected to the drains of said first NMOS transistor and said second NMOS transistor; and, a feedback loop configured to be the output of said amplifier.

In addition, a method of a voltage reference circuit comprises the following steps, (a) providing a voltage reference circuit comprises a first MOSFET current mirror with a threshold voltage difference, a second MOSFET current mirror, an amplifier, a feedback loop, and an output signal, (b) establishing a drain voltage difference from said first MOSFET current mirror with a threshold voltage difference, (c) feeding the MOSFET drain voltages of said first MOSFET current mirror with a threshold voltage difference to the inputs of said amplifier, (d) establishing an amplifier output signal from said amplifier; and, lastly (e) feeding the amplifier output signal to a feedback loop.

Other advantages will be recognized by those of ordinary skill in the art.

BRIEF DESCRIPTION OF THE DRAWINGS

The present disclosure and the corresponding advantages and features provided thereby will be best understood and appreciated upon review of the following detailed description of the disclosure, taken in conjunction with the following drawings, where like numerals represent like elements, in which.

DETAILED DESCRIPTION

Figure 1:
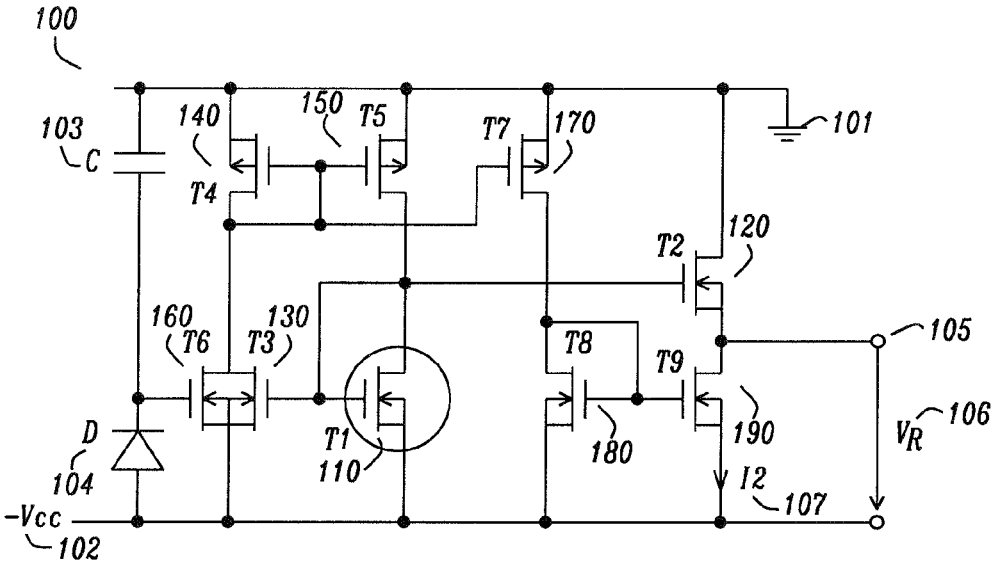
FIG. 1 Prior Art
FIG. 1 is a prior art example of a voltage reference circuit.
Figure 2:
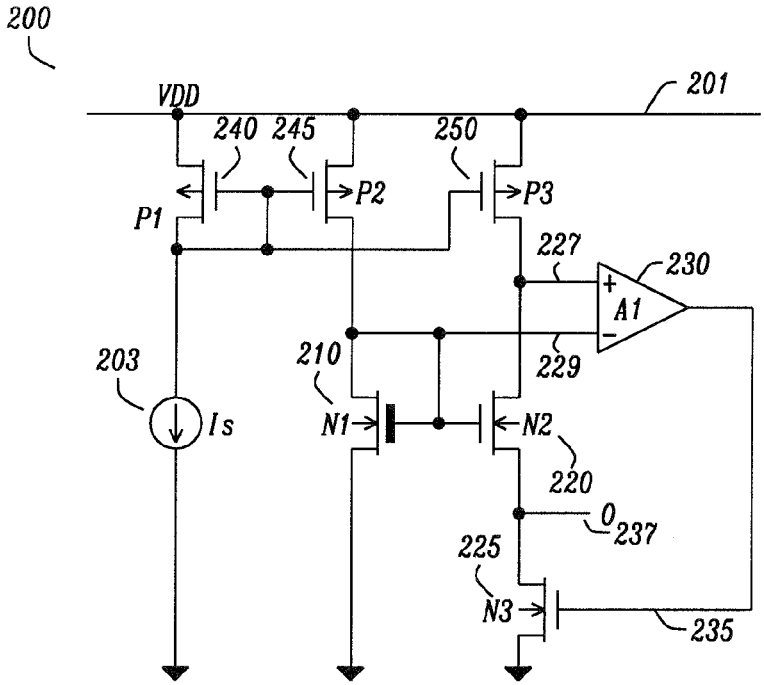
FIG. 2 is a circuit schematic of a voltage reference circuit in accordance with an embodiment of the disclosure.

FIG. 2 is a circuit schematic of a voltage reference circuit 200 in accordance with an embodiment of the disclosure. The threshold voltage of n-channel metal oxide semiconductor (MOS) N1 210 is higher than that of n-channel MOS N2 220 and the difference between these threshold voltages appears at output node O 237 if p-channel MOS P2 245 and p-channel MOS P3 250 have good matching in terms of their electrical characteristics. The currents flowing through p-channel MOS P2 245 and p-channel MOS P3 250 are not necessarily equal but the ratio of them should be constant. So the gate areas of p-channel MOS P2 245 and p-channel MOS P3 250 are needed to be big to reduce random variation which worsens the matching of currents of the p-channel MOS P2 245 and p-channel MOS P3 250. The n-channel MOS N1 210 and n-channel MOS N2 220 also need to be big so that the difference of threshold voltages between two transistors n-channel MOS N1 210 and n-channel MOS N2 220 are stable.

Mentioned above, in this circuit, high precision matching is required only on two pairs, the p-channel MOS pair P2-P3 (P2 245 and P3 250) and the n-channel MOS pair N1-N2 (N1 210 and N2 220); this means only four big transistors are needed in the circuit.

The amplification gain, A1 230 is the only required voltage gain and its large input offset is tolerated, so the size of this amplifier could be quite small and it has no area impact. No matching properties are required on the p-channel MOS P1 240 and the n-channel MOS N3 225 because they are a bias voltage source and auto-controlled resistor respectively.

The power supply, VDD 201, by being independent of output voltage O (e.g. power supply voltage independence) is another merit of this invention. In the circuit, drain voltages of p-channel MOS P2 245 and the p-channel MOS P3 250 are always controlled to be equal in magnitude as a result of the negative feedback loop. This is inclusive of the voltage amplification gain A1 230 and n-channel MOS N3 225, so the current ratio between the two p-channel MOS transistors, P2 245 and P3 250, are independent of the power supply voltage VDD. As a result, output voltage is not sensitive to the power supply voltage VDD.

Figure 3:
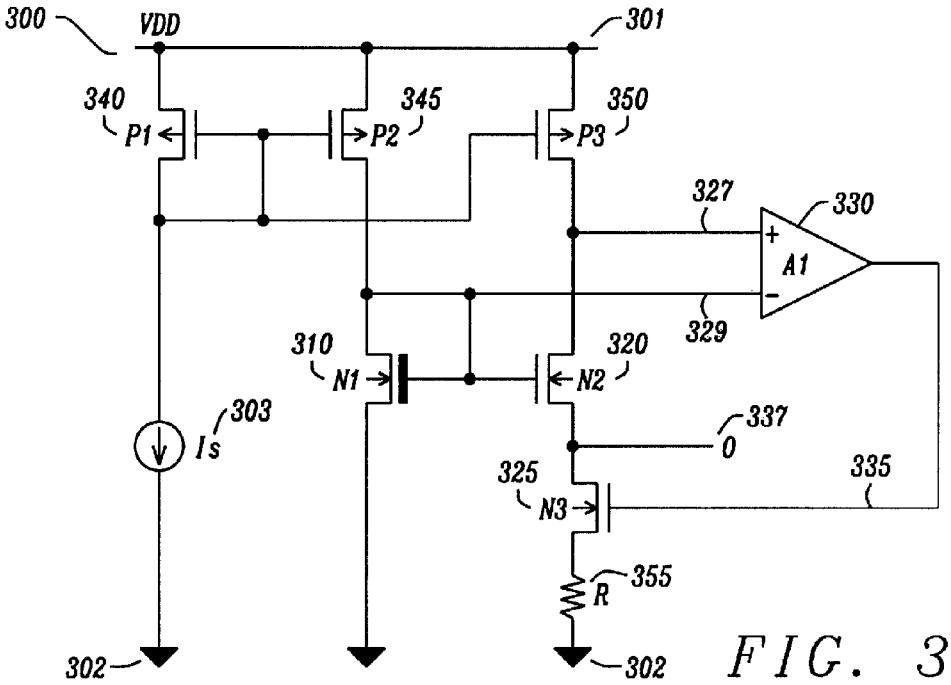
FIG. 3 is a circuit schematic of a voltage reference circuit in accordance with an embodiment of the disclosure.

FIG. 3 is a circuit schematic of a voltage reference circuit 300 in accordance with a further embodiment of the disclosure. In some cases, the gain of loop on A1 330-N3 325-N2 320 might be too large in magnitude in order to get enough phase margin. Then the loop gain could be decreased by putting a resistor between the source of the n-channel MOS N3 325 and the ground 302. The embodiment 300 comprises a VDD 301 and ground VSS 302. A current mirror is formed with transistor N1 310 and transistor N2 320. Differential inputs for amplifier A1 330 are input 327 and input 329 connected to the drain of the N1 310, and N2 320. A second current mirror is formed with p-channel MOSFET P1 340, P2 345, and P3 350. The current source 303 establishes a current Is and is connected to the p-channel MOSFET current mirror. The amplifier A1 330 provides a feedback signal 335 to n-channel MOSFET N3 325. The drain of N3 325 is coupled to output O 337 and whose source is connected to resistor R 355.

Figure 4:
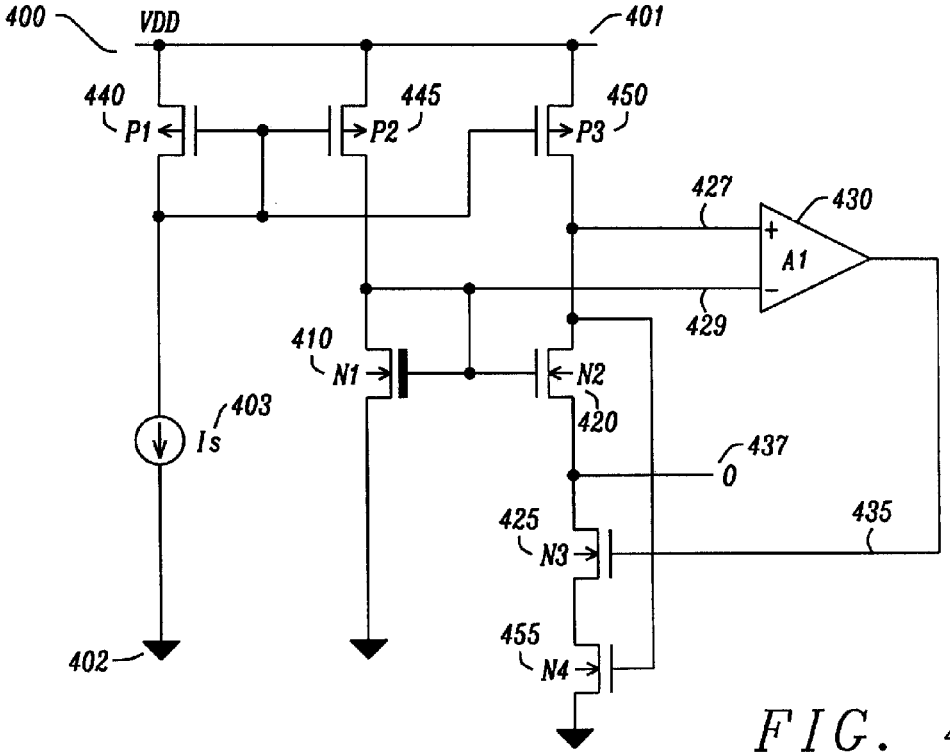
FIG. 4 is a circuit schematic of a voltage reference circuit in accordance with an embodiment of the disclosure.

FIG. 4 is a circuit schematic of a voltage reference circuit 400 in accordance with another embodiment of the disclosure. This is another method to decrease the loop gain. The embodiment 400 comprises a VDD 401 and ground VSS 402. A current mirror is formed with transistor N1 410 and transistor N2 420. Differential inputs for amplifier A1 430 are input 427 and input 429 connected to the drain of the N1 410, and N2 420. The drain of N2 420 is coupled to the gate of n-channel MOSFET N4 455. A second current mirror is formed with p-channel MOSFET P1 440, P2 445, and P3 450. The current source 403 establishes a current Is and is connected to the p-channel MOSFET current mirror. The amplifier A1 430 provides a feedback signal 435 to n-channel MOSFET N3 425. The drain of N3 425 is coupled to output O 437. In this circuit, the n-channel MOSFET device N4 455 is added instead of the resistor R 355 of FIG. 3. The resistor R 355 of FIG. 3 might need a large area due to the magnitude of the resistor value. In that case, using an n-channel metal oxide field effect transistor (NMOSFET) N4 455 is less physical area compared to a resistor element.

Figure 5:
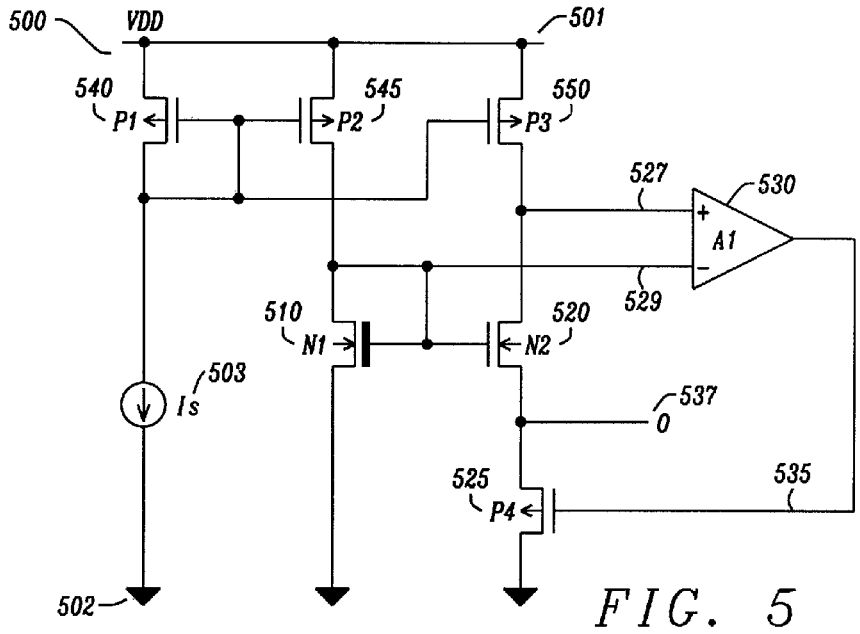
FIG. 5 is a circuit schematic of a voltage reference circuit in accordance with an embodiment of the disclosure.

FIG. 5 is a circuit schematic of a voltage reference circuit 500 in accordance with another embodiment of the disclosure. Another method to decrease the loop gain is achieved with this circuit embodiment. The embodiment 500 comprises a VDD 501 and ground VSS 502. A current mirror is formed with transistor N1 510 and transistor N2 520. Differential inputs for amplifier A1 530 are input 527 and input 529 connected to the drain of the N1 510, and N2 520. A second current mirror is formed with p-channel MOSFET P1 540, P2

545, and P3 550. The current source 503 establishes a current Is and is connected to the p-channel MOSFET current mirror. The amplifier A1 530 provides a feedback signal 535 to p-channel MOSFET P4 525. If the threshold voltage of the p-channel MOS P4 525 is low, it doesn't affect the voltage of output O 537, and as a result, this circuit will have good output accuracy and good stability (e.g. because of lowest loop gain).

Figure 6:
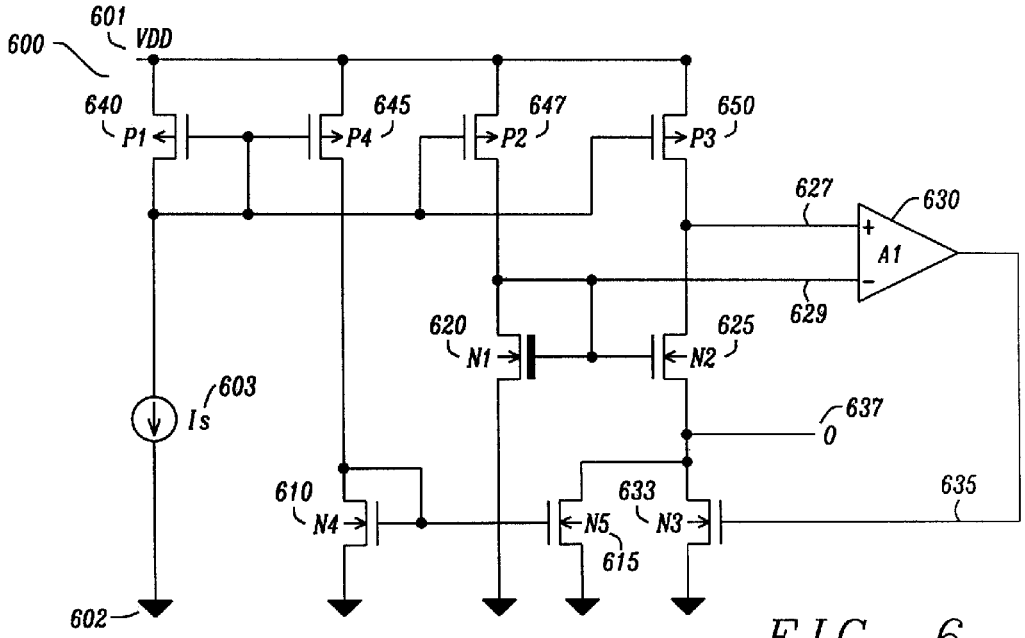
FIG. 6 is a circuit schematic of a voltage reference circuit in accordance with an embodiment of the disclosure.

FIG. 6 is a circuit schematic of a voltage reference circuit 600 in accordance with an embodiment of the disclosure. The embodiment 600 comprises a VDD 601 and ground VSS 602. A current mirror is formed with transistor N1 620 and transistor N2 625. Differential inputs for amplifier A1 630 are input 627 and input 629 connected to the drain of the N1 620, and N2 625. A second n-channel current mirror is formed with transistor N4 610 and transistor 615. A third current mirror is formed with p-channel MOSFET P1 640, P4 645, P2 647 and P3 650. The current source 603 establishes a current Is and is connected to the p-channel MOSFET current mirror. The amplifier A1 630 provides a feedback signal 635 connecting to the gate of n-channel MOSFET N3 633. The drain of N3 633 and N5 615 is connected to output O 637. In this circuit, n-channel MOS N4 610, the n-channel MOS N5 615 and p-channel P4 645 is added to the first embodiment. These transistors do not require high matching properties to other MOSFETs, and can be physically small. The n-channel N5 615 is sinking equal to or less current than the source current of the p-channel MOS (PMOS) P3 650. The voltage gain A1 630 control current of the n-channel N3 630 are such that the n-channel currents of the third and fifth transistor (In3+In5) are equal to p-channel current of the third PMOS Ip3. N-channel current of the third NMOS In3, n-channel current of the fifth NMOS In5 and p-channel transistor current Ip3 are drain currents of transistors N3 633, N5 615 and P3 650, respectively. In this embodiment, the controllable range of current of the n-channel MOSFET N3 is allowed to be narrow, so the loop gain is less than that in the first embodiment. The maintaining of stability in this embodiment is easier.

Figure 7:
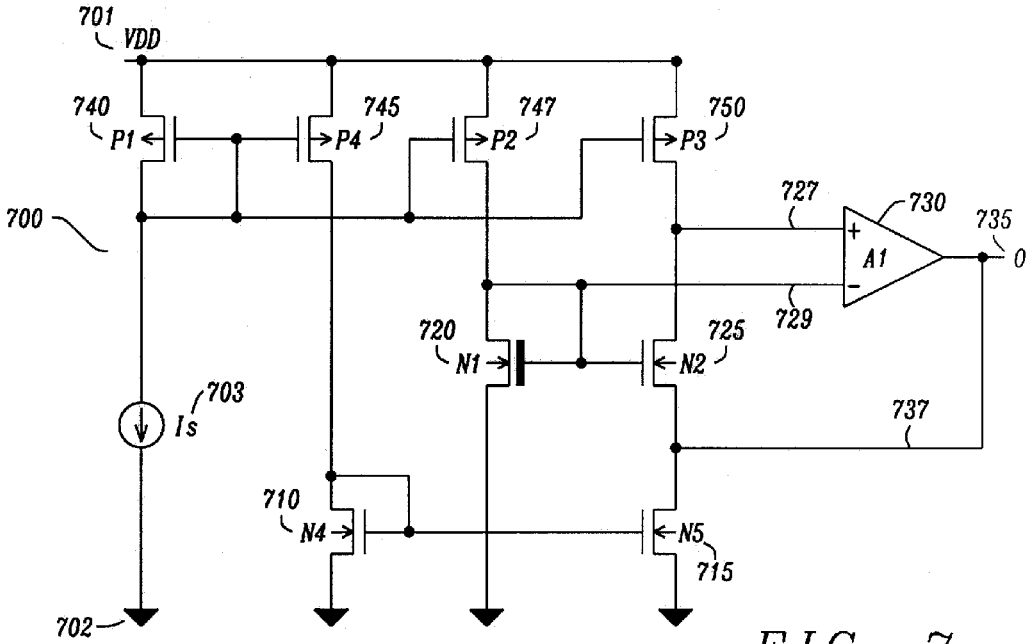
FIG. 7 is a circuit schematic of a voltage reference circuit in accordance with an embodiment of the disclosure.
Figure 8:
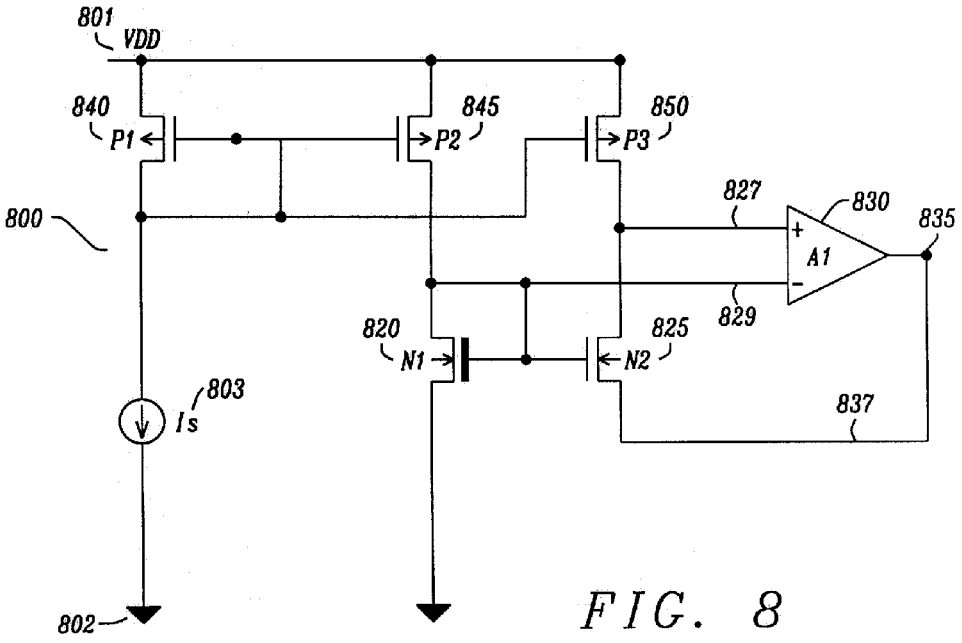
FIG. 8 is a circuit schematic of a voltage reference circuit in accordance with an embodiment of the disclosure; and, FIG. 9 is a method for providing a voltage reference circuit in accordance with an embodiment of the disclosure.

FIG. 7 is a circuit schematic of a voltage reference circuit 700 in accordance with an embodiment of the disclosure. The embodiment 700 comprises a VDD 701 and ground VSS 702. A current mirror is formed with transistor N1 720 and transistor N2 725. Differential inputs for amplifier A1 730 are input 727 and input 729 connected to the drain of the N1 720, and N2 725. A second n-channel current mirror is formed with transistor N4 710 and transistor 715. A third current mirror is formed with p-channel MOSFET P1 740, P4 745, P2 747 and P3 750. The current source 703 establishes a current Is and is connected to the p-channel MOSFET current mirror. The amplifier A1 730 provides an output signal O 735 and feedback signal 737. In this embodiment 700, n-channel MOSFET N4 710, and N5 715 and p-channel MOSFET P4 745 do not require high-matching properties, and as a result, can be small (e.g. note that this is the same as in true in the previous embodiment). The current of the n-channel MOS (NMOS) N5 715 should be less than the current of the p-channel MOS (PMOS) P3 750 and the sum of the current of N5 715 and the sink current of amplifier A1 730 without load current is equal to the current of the 750. In this circuit, the output voltage O 735 is just the output of amplifier A1 730. As a result, the output impedance can be very low and the circuit can drive a heavier load than other embodiments of this invention FIG. 8 is a circuit schematic of a voltage reference circuit 800 in accordance with an embodiment of the disclosure. The embodiment 800 comprises a VDD 801 and ground VSS 802. A current mirror is formed with transistor N1 820 and transistor N2 825. Differential inputs for amplifier A1 830 are input 827 and input 829 connected to the drain of the N1 820, and N2 825. A second current mirror is formed with p-channel MOSFETs P1 840, P2 845, and P3 850. The current source 803 establishes a current Is and is connected to the p-channel MOSFET current mirror. The amplifier A1 830 provides an output signal O 835 and feedback signal 837. In this embodiment 800, N4, N5 and P4 of FIG. 7 are not required. The output current range of amplifier A1 835 is required wider than that of the previous embodiment (FIG. 7) but the low output impedance is also expected as in the previous embodiment (FIG. 7). The interesting feature of this circuit is that even though the output of this embodiment is the output of the amplifier A1 830 itself, the offset voltage of the amplifier doesn't affect the voltage of O 835. The above is true in a first order sense, but if the channel conductance of one of 720, 725, 747 and 750 at least is significantly large, then there is a second order impact on O 835 due to an offset on amplifier A1 830 which would cause the drain source voltage difference.

Figure 9:
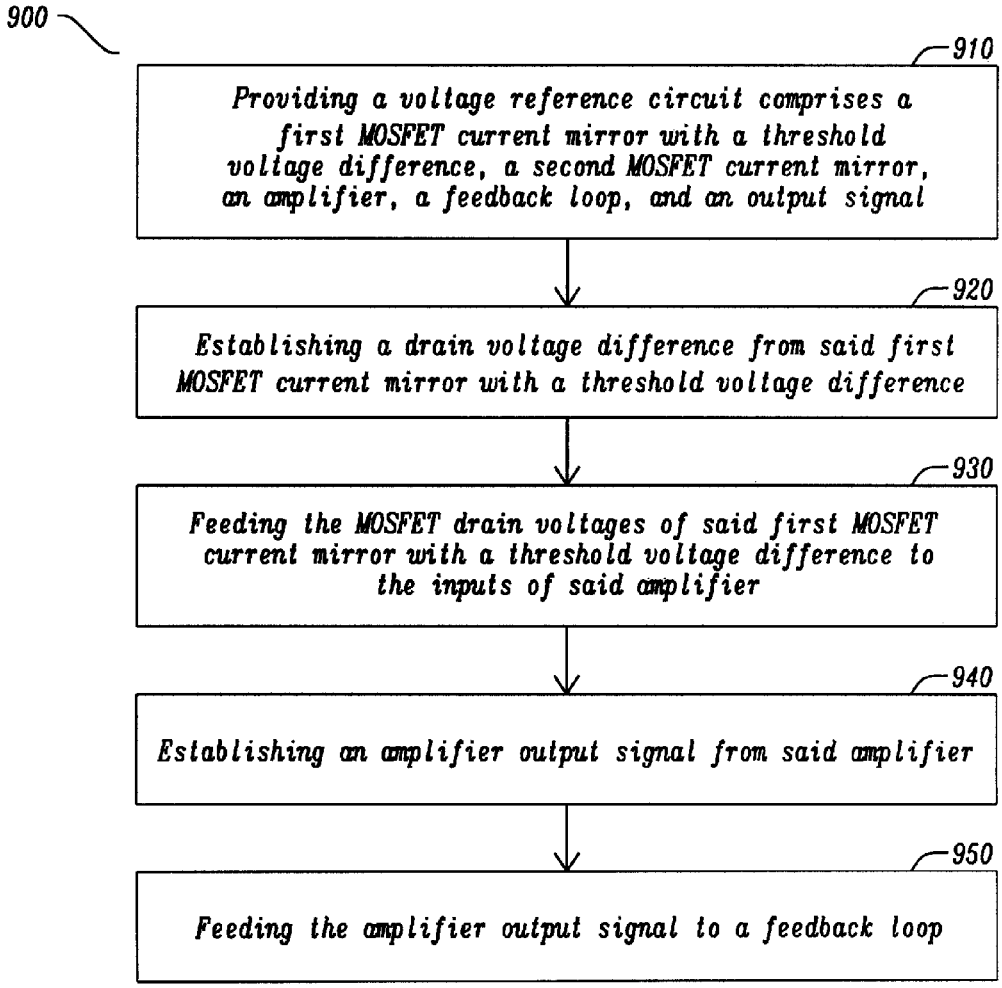

FIG. 9 is a method for providing a voltage reference circuit in accordance with an embodiment of the disclosure. A method of a voltage reference circuit 900 comprises the steps, the first step 910 (*a*) providing a voltage reference circuit comprises a first MOSFET current mirror with a threshold voltage difference, a second MOSFET current mirror, an amplifier, a feedback loop, and an output signal, the second step 920 (*b*) establishing a drain voltage difference from said first MOSFET current mirror with a threshold voltage difference, the third step 930 (*c*) feeding the MOSFET drain voltages of said first MOSFET current mirror with a threshold voltage difference to the inputs of said amplifier, the fourth step 940 (*d*) establishing an amplifier output signal from said amplifier; and, the last step 950 (*e*) feeding the amplifier output signal to a feedback loop.

It is recognized by those skilled in the art that the embodiments in this disclosure can be implemented with the substitution of n-channel as p-channel MOSFETs and p-channel MOSFETs as n-channel MOSFETs with the modifications in the power supply and ground connections. It is also understood by those skilled in the art that the following disclosure can be achieved using other types of field effect transistor structures, such as lateral diffused MOS (LDMOS). In advanced technologies, it is also understood that the embodiments can be formed using FINFET devices instead of planar MOSFETs.

Other advantages will be recognized by those of ordinary skill in the art. The above detailed description of the disclosure, and the examples described therein, has been presented for the purposes of illustration and description. While the principles of the disclosure have been described above in connection with a specific device, it is to be clearly understood that this description is made only by way of example and not as a limitation on the scope of the disclosure.

What is claimed is:

1. A voltage reference circuit between a power supply node and a ground node and configured for generating a reference voltage comprising:

a first current mirror with a first NMOS transistor and a second NMOS transistor wherein said first NMOS transistor threshold voltage is not equal to said second NMOS transistor threshold voltage;

a second current mirror with a first PMOS transistor, a second PMOS transistor and third PMOS transistor configured to be coupled to said power supply node, wherein the first PMOS transistor is coupled to the gate of the second PMOS transistor, and third PMOS transistor, and wherein said second PMOS transistor and third PMOS transistor drains are coupled to said first NMOS transistor drain and said second NMOS transistor drain, respectively;

a current source configured to provide current to said second current mirror;

an amplifier configured with a first and second input configured to be connected to the drains of said first NMOS transistor and said second NMOS transistor; and, a feedback loop configured to be the output of said amplifier.

2. The circuit of claim 1 wherein said feedback loop is configured to be connected to a third NMOS transistor.

3. The circuit of claim 2 wherein said feedback loop is configured to be connected to the gate of the third NMOS transistor.

4. The circuit of claim 3 wherein said third NMOS transistor source is connected to a resistor element providing a decreased loop gain and improved phase margin.

5. The circuit of claim 3 wherein said third NMOS transistor source is configured to be connected to the drain of a fourth NMOS transistor providing a decreased loop gain and improved phase margin.

6. The circuit of claim 5 wherein said fourth NMOS transistor gate is connected to said second NMOS transistor drain.

7. The circuit of claim 3 further comprising:

a third current mirror comprises a fourth NMOS transistor configured with its gate and drain coupled, and a fifth NMOS transistor coupled to the third NMOS transistor drain; and, a fourth PMOS transistor whose gate is coupled to the second current mirror gate of said first PMOS transistor and whose drain is coupled to said fourth NMOS transistor.

8. The circuit of claim 2 wherein said feedback loop is configured to be connected to the gate of a fourth PMOS transistor.

9. The circuit of claim 1 further comprising:

a third current mirror comprising a third NMOS transistor configured with its gate and drain coupled, and a fourth NMOS transistor coupled to the drain of said second NMOS transistor and feedback loop; and, a fourth PMOS transistor whose gate is coupled to the second current mirror gate of said first PMOS transistor and whose drain is coupled to said third NMOS transistor.

10. The circuit in claim 1 wherein said feedback loop is configured to be coupled to the drain of the second NMOS transistor.

11. A method of a voltage reference circuit comprising the steps of:

providing a voltage reference circuit comprises a first MOSFET current mirror with a threshold voltage difference, a second MOSFET current mirror, an amplifier, a feedback loop, and an output signal;

establishing a drain voltage difference from said first MOSFET current mirror with a threshold voltage difference;

feeding the drain voltages of said first MOSFET current mirror with a threshold voltage difference to the inputs of said amplifier;

establishing an amplifier output signal from said amplifier; and, feeding the amplifier output signal to a feedback loop.

12. The method of claim 11 wherein said first MOSFET current mirror with a threshold voltage difference comprises a first n-channel MOSFET and a second n-channel MOSFET, wherein said first n-channel MOSFET has a different threshold voltage from said second n-channel MOSFET.

13. The method of claim 12 further comprising a third n-channel MOSFET coupled to said feedback loop, and said second n-channel MOSFET.

14. The method of claim 13, further comprising the steps of:

feeding the signal of the feedback loop to said third n-channel MOSFET gate;

establishing an output signal from said third n-channel MOSFET drain node.

15. The method of claim 14, further comprising a resistor element coupled to the source of said third n-channel MOSFET providing a decreased loop gain and improved phase margin.

16. The method of claim 14, further comprising a fourth n-channel MOSFET coupled to the source of said third n-channel MOSFET providing a decreased loop gain and improved phase margin.

17. The method of claim 14, wherein said second MOSFET current mirror comprising a first p-channel MOSFET, a second p-channel MOSFET, a third p-channel MOSFET, and a fourth p-channel MOSFET.

18. The method of claim 17, further comprising a third MOSFET current mirror wherein said third MOSFET current mirror is sourced by said second MOSFET current mirror and coupled to said output signal providing controlled range of current through said third n-channel MOSFET, and improved stability.

19. The method of claim 12 wherein said second MOSFET current mirror comprising a first p-channel MOSFET, a second p-channel MOSFET, and a third p-channel MOSFET.

20. The method of claim 19 further comprising a fourth p-channel MOSFET coupled to said feedback loop, and said second n-channel MOSFET.

21. The method of claim 20, further comprising the steps of:

feeding the signal of the feedback loop to said fourth p-channel MOSFET gate; and, establishing an output signal from said fourth p-channel MOSFET drain node.

22. The method of claim 12 further comprising a second MOSFET current mirror comprises a first p-channel MOSFET, a second p-channel MOSFET, a third p-channel MOSFET, and a fourth p-channel MOSFET.

23. The method of claim 22 further comprising of a third MOSFET current mirror comprises a third n-channel MOSFET and a fourth n-channel MOSFET.

24. The method of claim 23 further comprising the steps of:

sourcing said third MOSFET current mirror with said second MOSFET current mirror;

coupling said third MOSFET current mirror to said first MOSFET current mirror;

coupling said output loop to said fourth n-channel MOSFET of said third MOSFET current mirror; and, out-putting an output signal from said amplifier.

25. The method of claim 12, wherein said feedback loop is coupled to the source of said second n-channel MOSFET source of said first MOSFET current mirror.

26. The method of claim 25, further comprising the steps of:

feeding the feedback signal to said first MOSFET current mirror; and, out-putting an output signal from said amplifier.

* * * * *